United States Patent [19]

Lonsmin

[11] 4,330,954

[45] May 25, 1982

[54] LIGHTER COVER

[76] Inventor: Victor Lonsmin, 1406 Ogden, LaGrange, Ill. 60525

[21] Appl. No.: 239,660

[22] Filed: Mar. 2, 1981

[51] Int. Cl.[3] ..... G09F 7/00

[52] U.S. Cl. ..... 40/486; 431/126; 40/10 D

[58] Field of Search ..... 40/10 D, 584, 486

[56] References Cited

U.S. PATENT DOCUMENTS

| | | | |
|---|---|---|---|
| 1,258,470 | 3/1918 | Schissel | 40/488 |
| 1,379,642 | 5/1921 | Meeks | 40/486 |
| 2,264,194 | 11/1941 | Wuestman | 40/334 |
| 2,547,312 | 4/1951 | Genovese | 40/324 |
| 2,844,893 | 7/1958 | Keller | 40/310 |
| 2,984,035 | 5/1961 | Nalle | 40/324 |
| 3,250,033 | 5/1966 | Siegel | 40/334 |
| 3,293,787 | 12/1966 | MacMahon | 40/19 |
| 3,343,293 | 9/1967 | Kirklen | 40/334 |

*Primary Examiner*—Gene Mancene
*Assistant Examiner*—Wenceslao J. Contreras
*Attorney, Agent, or Firm*—Michael Piontek

[57] ABSTRACT

The cigarette lighter cover is a novelty sleeve for the cigarette lighter which has a tubular body portion with a hollow interior space sized to receive the body of the cigarette lighter of conventional design. One end of the body portion is closed off to form a bottom end of the sleeve. The other end of the body portion is open to receive the cigarette lighter. An image presenting assembly is situated on one side of the sleeve and includes a filmstrip. Opaque portions of this filmstrip have a desired color to provide a portion of an image and a translucent portion has the remaining portion of the image which is caused to appear and disappear. A dark background is situated behind the translucent portion of the filmstrip and a light colored shield is positioned behind the filmstrip and between the filmstrip and the dark background. The shield has a handle for moving the shield to and from a position behind the portion of the image defined by the translucent portion of the filmstrip thereby to cause it to appear when the shield is moved therebehind.

15 Claims, 6 Drawing Figures

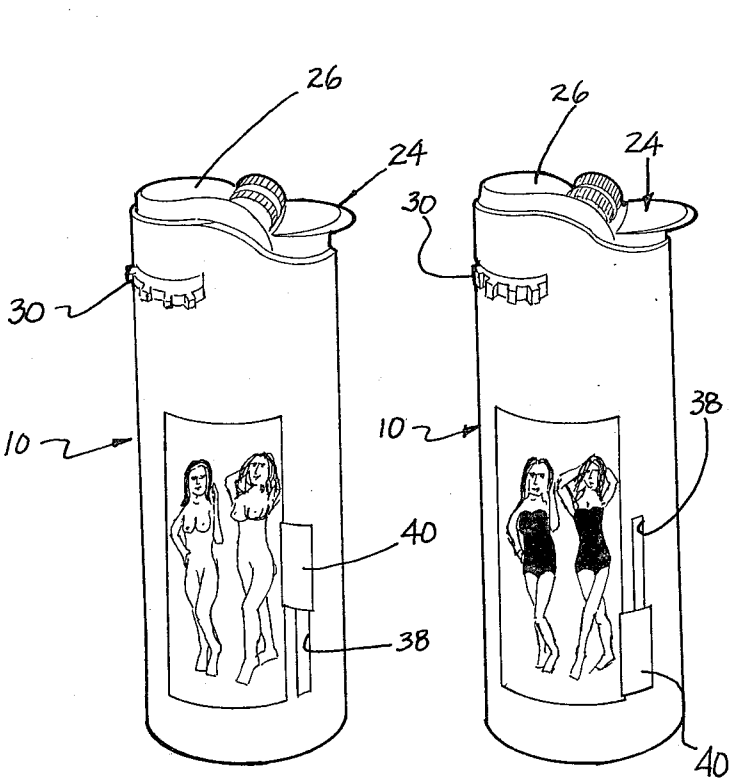
Fig. 3
Fig. 2
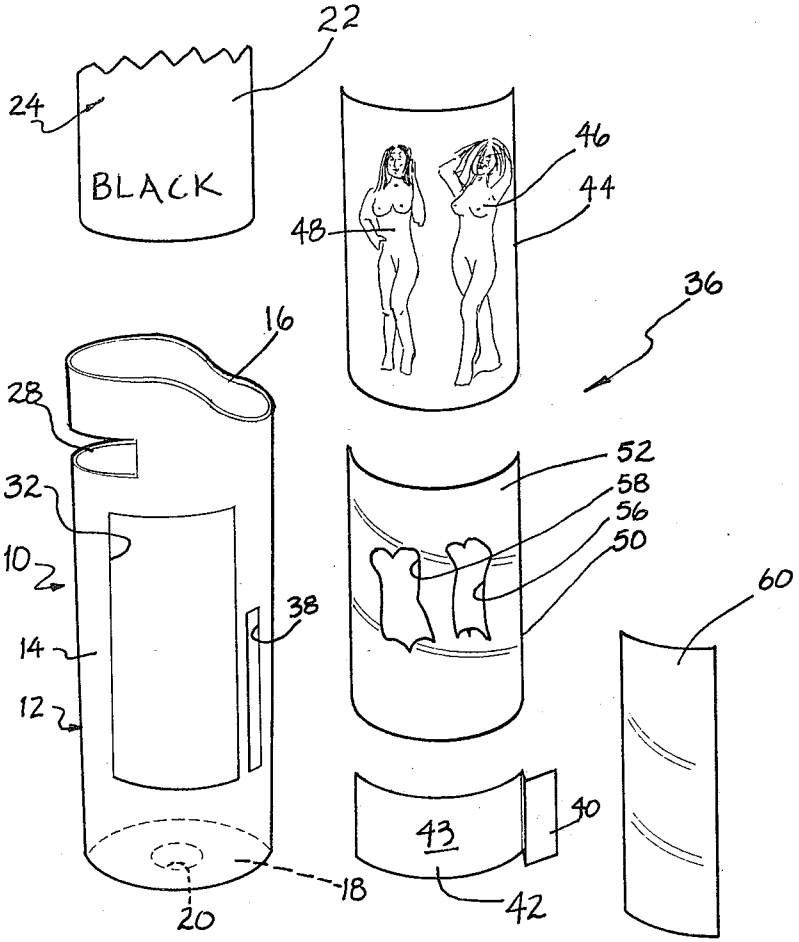
Fig. 1

LIGHTER COVER

BACKGROUND OF THE INVENTION

1. Field of the Invention

The present invention relates to a novelty sleeve providing a cover for a cigarette lighter. More specifically, the present invention relates to a novelty sleeve having an image presenting assembly on the side thereof for causing an image to appear and disappear.

2. Description of the Prior Art

Heretofore, a novelty writing instrument having an appearing and disappearing personal name has been proposed. Such a novelty writing instrument is disclosed in U.S. Pat. No. 4,037,343 issued on July 26, 1977 to Victor Lonsmin.

Cigarette lighters of the disposable type have become very popular in the marketplace and are made inexpensively with little or no ornamentation since they are throw-away items.

The novelty sleeve of the present invention is designed to provide ornamentation for the conventional, inexpensive, throw-away cigarette lighter. Also, the novelty sleeve will individualize the cigarette lighter for the owner thereof so that he or she knows that a particular lighter is his or her lighter by reason of the novelty sleeve thereon.

Also, the novelty sleeve, by having an appearing and disappearing image thereon as will be described in greater detail hereinafter, provides a conversational piece and provides entertainment for friends and guests of the owner thereof.

As will be described in greater detail hereinafter, the novelty sleeve of the present invention which provides a cover for a cigarette lighter has an image presenting assembly thereon and a handle which can be moved to cause part of the image to appear or disappear.

SUMMARY OF THE INVENTION

According to the invention there is provided a novelty sleeve for a cigarette lighter comprising a tubular body portion having a hollow interior space sized to receive the body of a cigarette lighter of conventional design, one end of said body portion being closed off to form a bottom end of said sleeve, the other end of said body portion being open to receive the body of a cigarette lighter therein, image presenting means on a side of said sleeve including a filmstrip with opaque portions of said filmstrip having a desired color to provide a portion of an image and a translucent portion having the remaining portion of the image which is caused to appear and disappear, a dark background situated behind said translucent portion of the filmstrip and means for moving a light colored shield behind the filmstrip and between the filmstrip and said dark background so as to enable the portion of the image defined by the translucent portion of the filmstrip to be caused to appear when the shield is moved therebehind.

BRIEF DESCRIPTION OF THE DRAWINGS

FIG. 1 is an exploded, perspective view of the novelty sleeve of the present invention, the component parts of which form a cigarette lighter cover with a disappearing image.

FIG. 2 is a perspective view of the assembled novelty sleeve of FIG. 1 with a cigarette lighter therein with the light color surface of a movable shield positioned behind a translucent portion of an image on a filmstrip, thereby to show the image of nude figures.

FIG. 3 is a perspective view of the assembled novelty sleeve with a cigarette lighter therein similar to FIG. 2 and showing the shield moved away from the translucent portion of the filmstrip such that a dark background therebehind gives the appearance of the two figures wearing bathing suits.

DESCRIPTION OF THE PREFERRED EMBODIMENTS

Figure 6:
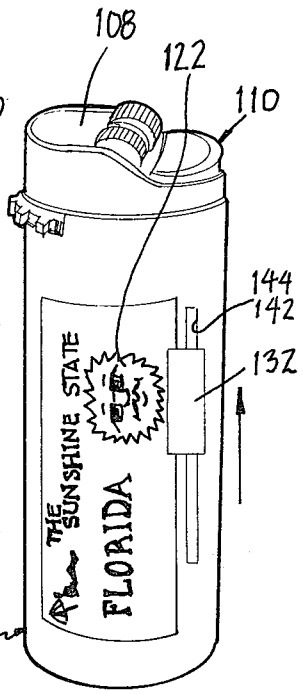
FIG. 6 is a perspective view similar to FIG. 5 and shows the shield moved to a position where the light surface of the shield is behind the translucent portion of the filmstrip so that a previously unseen image now appears on the side of the novelty sleeve.

Referring now to the drawings in greater detail, there is illustrated in FIG. 1 an exploded, perspective view of the cigarette lighter cover 10 of the present invention. As shown, the cigarette lighter cover 10 includes a sleeve 12 having a tubular body portion 14, an upper open end portion 16, and a closed bottom portion 18. If desired, the closed bottom portion 18 can have a hole 20 therein to provide a passage for the device found on the bottom of some disposable cigarette lighters. A bottom body portion 22 of a disposable cigarette lighter 24 is shown above the open end 16 and is adapted to be received therein.

As shown, the open end 16 is configured to mate with the top 26 (FIG. 2) of a conventional cigarette lighter 24. Also, the upper part of the tubular body portion 14 has a groove 28 extending through the tubular body portion 14 for receiving a thumb-wheel 30 of the cigarette lighter 24 which is used for causing striking of a flint to light the cigarette lighter 24. The sleeve is made of a somewhat flexible material, like plastic, to permit it to be deformed slightly to permit the thumb-wheel 30 to pass when the lighter is inserted. Thus, the engagement of the thumb-wheel 30 in the groove 28 helps retain the sleeve to the lighter.

As shown, the tubular body portion 14 has a generally oval cross section for receiving a cigarette lighter having an oval cross section.

Also, the tubular body portion 14 is provided with a window 32 on one side thereof which is adapted to receive an image presenting assembly 36 shown in exploded view in FIG. 1.

The tubular body portion 14 also has a slot 38 therein adjacent the window 32 for receiving a handle 40 of a shield 42 to be described in greater detail below and which forms part of the image presenting assembly 36.

In addition to the shield 42, the image presenting assembly 36 includes a filmstrip 44 which in FIG. 1 has two nude figures 46 and 48 thereon. As typical of filmstrips, the filmstrip 44 is translucent and an image therein is caused to appear by presenting a light colored background. Accordingly, the assembly 36 further includes a background sheet 50 which has a backing surface 52 of a light color, such as white, which is adapted to be positioned behind the filmstrip 44. Two portions 56 and 58 are cut out of the background sheet 50 and have the configuration of a bathing suit which would fit over the middle portion of each nude. When assembled behind the filmstrip 44, the backing sheet 50 causes the upper and lower portions of the images 46 and 48 to appear in the desired color with the surrounding area appearing white. As will be described in greater detail hereinafter, the middle or torso portion of each nude figures 46, 48 will appear flesh color when the shield 42 is positioned behind the filmstrip 44 and behind the cutaway portions 56 and 58 and will appear dark, such as black, giving the appearance of black bathing suits on the figures, when the shield 42 is not disposed behind the cutaway portions 56 and 58.

The image presenting assembly 36 further includes a clear, transparent window pane 60 made of a clear plastic material such as cellophane.

In assembling the image presenting assembly 36 on the tubular body portion 14, the backing sheet 50 is fixed behind the filmstrip 44 and inserted in the window 32. Then the cover window pane 60 is placed on top of the filmstrip 44 and the shield 42 with the light colored or white surface 43 thereof facing outwardly is positioned within the tubular body portion 14 with the handle 40 extending through the slot 38.

Referring now to FIGS. 2 and 3, it will be apparent that when the shield 42 is in a first position with the white surface 43 thereof behind the cutaway portions 56 and 58, the full nude figures will appear as shown in FIG. 2. In this position, the handle 40 will be moved up in the slot 38 to an upper position in the slot 38 as shown. Then, when it is desired to have the figures 46 and 48 appear with bathing suits thereon, the handle 40 is pushed to the bottom of the slot 38 as shown in FIG. 3 where the white surface 43 of the shield 42 is not behind the cutaway portions 56 and 58. In this position, the background behind the cutaway portions 56 and 58 is the dark color of the body of the lighter which is typically black. Of course, it is to be appreciated that some lighters will be colored red or green, and so different colored bathing suits will appear on the figures 46 a 48 dependent upon the color of the body of the cigarette lighter 24.

It will be appreciated that the cigarette lighter cover 10 need not have a window 32 in a side of the tubular body portion 14. Instead, the whole image presenting assembly 36 including the shield 42, filmstrip 44, backing sheet 50 and the window pane 60, can all be secured on the outer surface of the tubular body portion 14. When so constructed, the dark color of the body portion 14 will provide a dark background behind the cutaway portions 56 and 58 when the shield 42 has been moved to a lower position.

Figure 5:
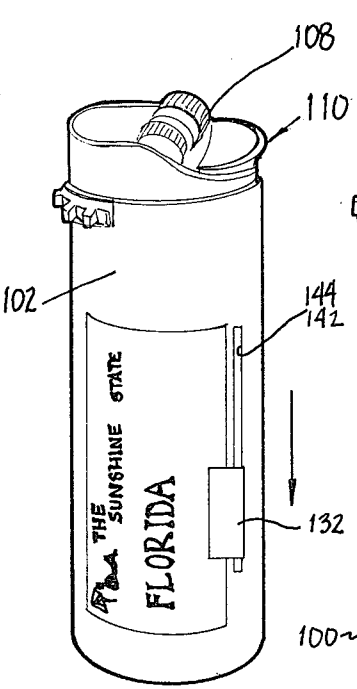
FIG. 5 is a perspective view of the assembled novelty sleeve of FIG. 4 with a cigarette lighter therein and showing the shield in a first position not backing the translucent portion of the filmstrip.
Figure 4:
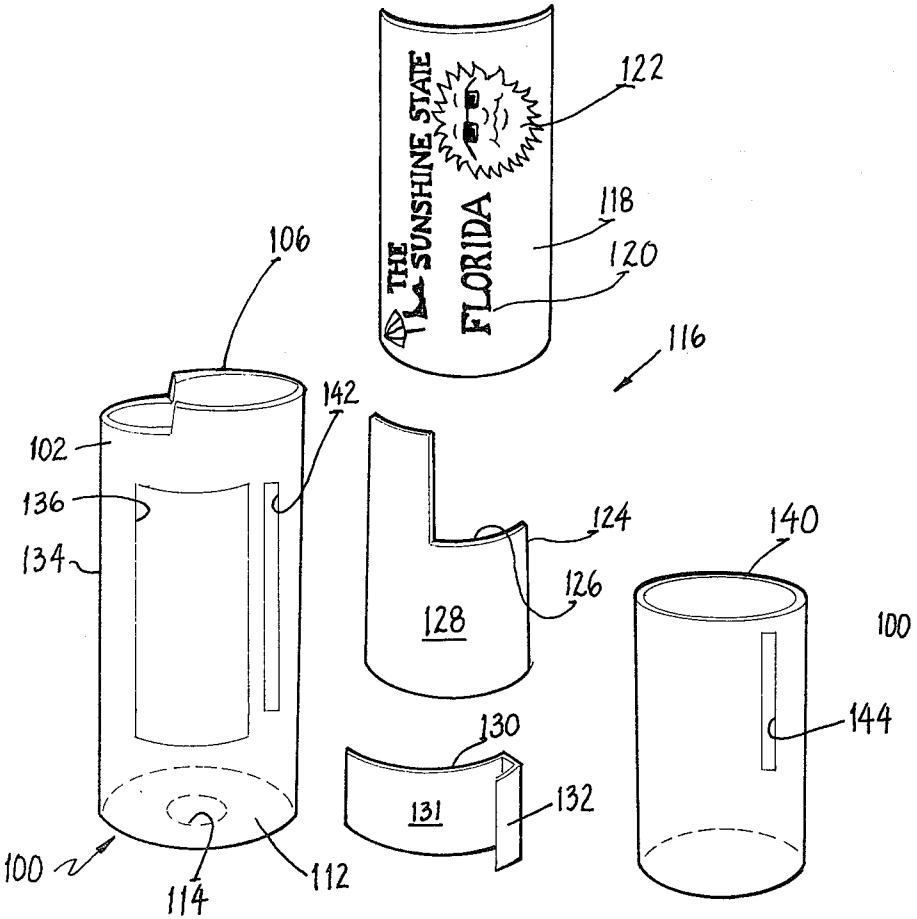
FIG. 4 is an exploded, perspective view of another embodiment of the novelty sleeve of the present invention wherein an annular portion of the body portion of the sleeve is cut away such that a tubular transparent window pane can be placed about the novelty sleeve.

Referring now to FIGS. 4, 5, and 6, there is illustrated therein another embodiment 100 of the cigarette lighter cover of the present invention. As shown, the cover 100 is in the shape of a novelty sleeve including a tubular body portion 102 having an upper open end 106 configured to terminate at one end below the lighter thumb-wheel and at the other end follows the top 108 of a conventional cigarette lighter 110. The tubular portion 102 also has a closed bottom end 112 with an opening 114 therethrough. Received on the tubular body portion 112 is an image presenting assembly 116 including a filmstrip 118 having images 120 which appear thereon and an image 122 which is caused to appear and disappear as will be described in greater detail below.

Fixed behind the filmstrip 118 is a white backing sheet 124 having a cutaway portion 126 which is positioned behind the appearing and disappearing image 122 which image is of a sun face. The surface 128 of the backing sheet 124 which is positioned behind the filmstrip 118 is light colored, typically white.

The image presenting assembly 116 further includes a shield 130 having a white surface 131 positioned to be moved behind the image 122 and a handle 132.

In this embodiment, the tubular portion 102 has an annular recessed portion 134 cut away from the tubular portion 102 as shown in FIG. 4. Through this annular recessed portion 134 is cut a window 136 similar to the window 32 shown in FIG. 1.

Instead of having a window pane of clear, transparent material such as cellophane, such as the window pane 60 shown in FIG. 1, the image presenting assembly 116 has a tubular clear, transparent member 140 which in assembling the assembly 116 is received over the tubular portion 102 and into the annular recess 134. A portion of the member 140 forms a window pane.

The tubular portion 102 in the area of the annular recessed portion 134 has a slot 142 formed therein which is located adjacent the window 136. The sleeve 140 has a mating slot 144 therein which is adapted to be positioned over and in registry with the slot 142.

In assembling the assembly 116 on the tubular portion 102, the filmstrip 118 with the backing sheet 124 fixed therebehind is positioned in the window 136. Then the shield 130 is positioned behind the backing sheet 124 and filmstrip 118 with the handle 132 received through the mating slots 142 and 144.

It will be understood that the parts of the assembly 116, and for that matter, the parts of the assembly 36, are fixed in place on the tubular portion 102 by a suitable adhesive.

As with the embodiment of the lighter cover 10 shown in FIGS. 1, 2 and 3, a dark background is positioned behind the cutaway portion 126. Typically such dark background portion is provided by the dark body color of the throw-away cigarette lighter. However, in the alternative, the window portion 136 can be cut only partway through the side of the tubular portion 102 so that the dark color of the tubular portion 102 provides the dark background. Preferably, such dark background is black.

As shown in FIGS. 5 and 6, the handle 132 can be moved between a first lower position shown in FIG. 5 where the shield 130 is not behind the image 122 to a second upper position as shown in FIG. 6 where the shield 130 is positioned behind the image 122 so as to cause the image 122 to appear as a result of the white background surface 131 being positioned behind the image 122. In this way, the image of a sun face can be caused to appear and disappear on the side of the tubular body portion 102 of the cover 100 for a cigarette lighter.

As noted previously, the cigarette lighter cover 10 or 100 of the present invention has a number of advantages, some of which have been described above and others of which are inherent in the invention. Specifically, the cover 10 or 100 provides an identification means for identifying a particular cigarette lighter to its owner. Also, the novelty appearing and disappearing image on the side of the tubular body portion of the cover or sleeve 10 or 100 provides entertainment and a conversation piece for the user thereof.

Many modifications can be made to the novelty sleeve forming a cigarette lighter cover of the present invention without departing from the teachings of the invention. For example, the upper configuration of sleeve 10 which has a groove for the thumb wheel can be used with a construction like that shown for the lower portion of sleeve 100. Also, the handle on the shield could be dispensed with, the shield being made to move by means of gravity. Accordingly, the scope of the present invention is only to be limited as necessitated by the accompanying claims.

I claim:

1. A novelty sleeve for a cigarette lighter comprising a tubular body portion having a hollow interior space sized to receive the body of a cigarette lighter of conventional design, one end of said body portion being closed off to form a bottom end of said sleeve, the other end of said body portion being open to receive the body of a cigarette lighter therein, image presenting means on a side of said sleeve including a filmstrip with opaque portions of said filmstrip having a desired color to provide a portion of an image and a translucent portion having the remaining portion of the image which is caused to appear and disappear, a dark background situated behind said translucent portion of the filmstrip and means for moving a light colored shield behind the filmstrip and between the filmstrip and said dark background so as to enable the portion of the image defined by the translucent portion of the filmstrip to be caused to appear when the shield is moved therebehind.

2. The sleeve according to claim 1 wherein said image presenting means include a window extending at least part way through said side of said sleeve.

3. The sleeve according to claim 2 wherein said window extends through said side of said sleeve portion and said dark background is provided by the dark body color of a cigarette lighter body portion inserted into said sleeve.

4. The sleeve according to claim 1 wherein said dark background is provided by the sleeve with said image forming means being mounted on the exterior surface of said side of said sleeve.

5. The sleeve according to claim 1 wherein a sheet of clear material is placed over said image.

6. The sleeve according to claim 1 wherein said sleeve has a generally oval cross section for receiving the body of a conventional oval cross section cigarette lighter.

7. The sleeve according to claim 1 wherein said closed bottom end of said sleeve has an opening therein.

8. The sleeve according to claim 1 wherein said dark background is black.

9. The sleeve according to claim 1 wherein said light color of the surface of said shield which is moved behind said translucent film strip is white.

10. The sleeve according to claim 1 wherein said image presenting means includes a backing sheet behind said filmstrip, said backing sheet having opaque light colored portions situated behind the portion of the filmstrip that has the desired color to provide that portion of the filmstrip image with the desired color and having an open portion adapted to be positioned in the area behind the translucent portion of said filmstrip.

11. The sleeve according to claim 1 wherein said tubular body portion of said sleeve has an elongate slot therein adjacent said image presenting means and said means for moving said light colored shield includes a handle extending from said shield through said slot for easy manipulation by the holder of said novelty sleeve with movement of said handle in the slot providing for movement of said shield between a first position not behind said translucent portion and a second position behind said translucent portion.

12. The sleeve according to claim 2 wherein said tubular body portion has an annular recessed portion and said sleeve includes a tubular sheet of clear, transparent material positioned in said annular recessed portion and extends over said window.

13. The sleeve according to claim 12 wherein said annular portion of said body portion adjacent said image presenting means has a slot therein, said tubular sleeve of clear, transparent material has a slot therein positioned to mate with said slot in said body portion and said means for moving said shield includes a handle extending from said shield through said slots where it can be manipulated to move said shield between a first position not behind said translucent portion and a second position behind said translucent portion.

14. The sleeve according to claim 1, wherein said tubular body portion has a groove therein adapted to receive the thumb-wheel of a conventional lighter to assist in retaining the sleeve to the lighter.

15. The sleeve according to claim 14, wherein said tubular body portion is made of a flexible material which permits said tubular body portion to deform momentarily to permit the thumb-wheel to slide into said groove when the lighter is inserted into said sleeve.

* * * * *